US011470916B2

(12) United States Patent
Dávila Moreno

(10) Patent No.: US 11,470,916 B2
(45) Date of Patent: Oct. 18, 2022

(54) INSOLE-SOCK INSERT FOR FOOTWEAR

(71) Applicant: Horacio Dávila Moreno, Huachinera (MX)

(72) Inventor: Horacio Dávila Moreno, Huachinera (MX)

( * ) Notice: Subject to any disclaimer, the term of this patent is extended or adjusted under 35 U.S.C. 154(b) by 59 days.

(21) Appl. No.: 16/639,303

(22) PCT Filed: Aug. 14, 2018

(86) PCT No.: PCT/MX2018/000072
§ 371 (c)(1),
(2) Date: Feb. 14, 2020

(87) PCT Pub. No.: WO2019/035706
PCT Pub. Date: Feb. 21, 2019

(65) Prior Publication Data

US 2020/0260822 A1 Aug. 20, 2020

(30) Foreign Application Priority Data

Aug. 14, 2017 (MX) ..... MX/u/2017/000369

(51) Int. Cl.
*A43B 17/18* (2006.01)

(52) U.S. Cl.
CPC ..... *A43B 17/18* (2013.01)

(58) Field of Classification Search
CPC ..... A43B 17/18; A43B 19/00; A43B 7/145
See application file for complete search history.

(56) References Cited

U.S. PATENT DOCUMENTS 1,501,349 A * 7/1924 Jung, Jr. ..... A61F 13/065 602/66
1,805,035 A * 5/1931 Branley ..... D04B 1/104 66/178 R
2,482,333 A * 9/1949 Everston ..... A43B 17/18 36/43
2,776,500 A * 1/1957 Gonsalves ..... A41B 11/006 36/10
3,334,356 A 8/1967 Abel
4,813,162 A * 3/1989 Harris ..... A43B 3/108 36/43
5,259,126 A * 11/1993 Rosen ..... A43B 23/28 36/97

(Continued)

FOREIGN PATENT DOCUMENTS

WO 2017003275 A1 1/2017

*Primary Examiner* — Jila M Mohandesi
(74) *Attorney, Agent, or Firm* — Adam R. Stephenson, Ltd.

(57) ABSTRACT

The implementation improves in the best possible way the integration between the insole and a modified sock, different than those currently known. The present implementation describes an insole-sock type insert for shoes, which presents a novel configuration that consists of an insole, which has a short, medium, or modified sock attached to it, totally or partially, within the extension of the insole; a short, medium, or modified sock, partially attached to the insole, remaining loose or free in the front part where the toes go and/or part of the instep as well as the front part of the foot, and; an attachment mechanism between the insole and the short, medium, or modified sock, which allows for their attachment, where such mechanism is a seam, Velcro, adhesive, or any other type of method that has the same function.

16 Claims, 11 Drawing Sheets

(56) References Cited

U.S. PATENT DOCUMENTS

| | | | | |
|---|---|---|---|---|
| 5,469,641 | A * | 11/1995 | Subotic | A43B 5/12 36/94 |
| 5,473,781 | A * | 12/1995 | Greenberg | A41B 11/003 2/239 |
| 5,867,838 | A * | 2/1999 | Corry | A43B 19/00 2/239 |
| 6,336,227 | B1 * | 1/2002 | Li | A41B 11/003 2/239 |
| 6,393,620 | B2 | 5/2002 | Hatch et al. | |
| 9,839,259 | B2 * | 12/2017 | Arquilla | A43B 19/00 |
| 11,129,442 | B2 * | 9/2021 | Arquilla | A43B 19/00 |
| 2002/0000002 | A1 | 1/2002 | Hatch et al. | |
| 2005/0011083 | A1 * | 1/2005 | Kosted | A43B 17/18 36/9 R |
| 2007/0283598 | A1 | 12/2007 | Gray | |
| 2008/0250669 | A1 * | 10/2008 | Hallivis | A43B 7/00 36/96 |
| 2016/0128427 | A1 * | 5/2016 | Meghani | A43B 17/18 36/43 |

* cited by examiner i)

ii)

iii)

i)

ii)

iii)

iv)

INSOLE-SOCK INSERT FOR FOOTWEAR

CROSS REFERENCE TO RELATED APPLICATIONS

This application is a national stage application of the earlier PCT Patent Application to Horacio Davila Moreno entitled "Insole-Sock Insert for Footwear," application number PCT/MX2018/000072, filed on Feb. 14, 2018, which application claims priority to Mexican Patent Application to Horacio Davila Moreno entitled "Insole-Sock Insert for Footwear," application number MX/u/2017/000369, filed on Feb. 14, 2017, the disclosures of each of which are hereby incorporated entirely herein by reference.

TECHNICAL FIELD

The present implementation, as is expressed in the title of this descriptive report, belongs to the field of foot inserts (insoles, socks, tines, amongst others) that are used for footwear. Particularly, we are referring to an insole-sock type insert for shoes, with improvements in the configuration and usefulness, which gives advantages in comparison to other type of foot inserts, whether they be soles, inserts, socks, tines, amongst others.

BACKGROUND

Currently, there exists some types of inserts, insoles, loafers, socks and/or footwear that are distinguished for possessing unique characteristics, but they do not solve problems this implementation in this descriptive report solves. Following, there is a state of the art report.

There are references of insole-sock type footwear made within the patent US20110061148 with an international publication of the United States of America, which shows a sock built with an integrated insole where the sock forms a pocket in the lower part where the insole is located and sealed. The insole will be permanently located within the sock and could not be removed without destroying such configuration. The implementation could be improved, however, the patent does not consider other improvements and results are totally different with respect to configuration and technical advantage from the one described in this descriptive report.

We also mention American U.S. Pat. No. 6,336,227 B1 which describes a sock which is worn with a nautical type shoe which has a frontal section and heel section, which are connected by an intermediate section and also counts with elastomeric strips. In reality, it is a traditional sock but formed with distinct materials and has a distinct knit between them and each one of the section mentioned.

The Spanish patent with application number 200101632 is also mentioned, which describes a perfected sock characterized because it presents a second layer within the knit of the foot's sole that jointly defines with that one a cavity fitted with an opening for the introduction of an insole inside, being impossible to remove such insole with respect to the foot.

We also found in Espacenet the publication of the Chinese patent with publication number CN2907274 (Y)—Jun. 6, 2007. This patent describes a sock and traditional insoles, both with a sealing component (for example, hook and loop fasteners) where upon making contact with one another they remain fixed. To separate them, more force is needed.

Up to this point, the corresponding assessment of the state of the art in regards to the technique of the implementations described herein (and others from the state of the art) shows that there were changes made to the configuration and to the materials used; but, there is still some disadvantages that exist when there is daily use given to these types of implementations, since they are not easy to use, cause the feeling of foot confinement and compression, besides the fact that there has not been a design made with a new configuration that includes the insole as a sock for the comfort of the user.

Currently, there is a big trend toward the "sockless look", which has given way to the creation of different types of socks, insoles, and sock inserts amongst other items in order to eliminate or reduce certain discomfort or disadvantages when socks are not worn.

Usually, there should be an effort made on behalf of the user in order to wear such products, which becomes even more complicated with elderly adults or those that are disabled, for example, they intend to wear these types of items for shoes. The implementation described in this descriptive report pertains to the type of implementation that gives the user a product with an ergonomic "sockless look" for its daily use, with an innovative design and/or functional structure technique.

The implementation is outlined below, mentioning the problems resolved, the advantages in its use, its configuration and other relevant characteristics that achieve a high degree of novelty and inventiveness.

SUMMARY

The present utility model describes an insole-sock type insert for shoes, which presents a functional technical configuration which provides advantages and functionalities that are superior to other type of insoles, socks, foot inserts, loafers, short socks, sock inserts, and/or any other type of shoe or garment.

Amongst the useful improvements or advantages of the implementation, the following was found: novelty integration of an insole (traditional implant, incomplete or modified) and a short sock of a variable size (by saying "short sock" we will understand it as referring to "short, medium, or modified sock") as just one product, where the sock and the insole show significant change for greater comfort, usefulness, and fit; better manipulation of the sock due to the fact that it is adhered to the insole (at a different height, depending on the length of the short sock) on just one axis; free mobility for the foot of the user due to the fact that the sock remains loose or is free from the insole, in other words, the sock takes the form of the foot and moves as the user moves his own foot; it is a washable product; adjustable to the insole, subject-matter of this implementation, within a determined size range, for example: insole-sock insert for shoe sizes 5-7 (Mexican), which will preferably have a frontal section of the insole that could be cut down if necessary in order to be used as an insole-sock for shoe sizes 5, 5½, 6, 6½, or leave it in the original size form the fabric to be used with size 7, depending on the manner in which the size range is established, or it could be handled as a one size fits all. Our implementation counts with other improvements that are specified below.

It deals with an original configuration and design which consists of an insole, which has attached on the partial or total extension of itself a short, medium, or modified sock; a short, medium, or modified sock, partially attached to the insole on one axis, remaining loose or free from the front part of the insole where the toes go, the frontal foot's instep and sole, depending on the size of the sock, that is short, medium, or modified; and a holding device between the insole and the short, medium, or modified sock, which allows for the attachment of both up to a certain point, where such holding device is a seam, a hook and loop fastener type joint, an adhesive or any other type of method that allows for the same function.

The short sock only covers the front part of the foot (toes, front part of the arch and front part of the foot) and is attached to the insole on just one axis at a medium height. The distance of the point of attachment of which the short sock attaches with the insole, can vary depending on the type of insole-sole type insert which will be tailored, since certain footwear needs a sock that that has to be in the front part of the insole (such as is the case for women, "ballerina type"), and for others, the sock should practically cover half or more of the insole if used with sneakers, nautical shoes, amongst others. In other words, the distance with which the sock and the insole are attached may vary depending on the type of footwear, since one of the primary functions is to obtain an insole-sock type insert that upon being used creates the impression that socks are not being worn, given the sockless look.

The insole plays an important role in our implementation, since it presents different modalities: 1. Traditional size insoles; 2. Modified insoles with variable configurations in such a manner that they show empty spaces in smaller sections than the total area of the insole, with these mainly being within the front part but also being able to be present throughout the majority of it, with only the contour remaining (forming a frame with a variable thickness perimeter), as well as having crossed lines with a variable thickness between such spaces of the same material as the insole in order to create firmness and stability to the structure of the insole; and 3. Incomplete insoles with a variable distance, being very useful for us its rear part (half where the heel is located). For descriptive reasons with respect to the implementation the three types of the previously mentioned insoles will be defined as: Traditional insole, modified insole, and incomplete insole, respectively.

The traditional and modified insoles are of a manually adjustable size, cutting part of the insole in order to reduce the corresponding shoe size. Such cut can be made in the frontal or rear part, depending on the insole configuration. The incomplete insole, upon not having the traditional front part of an insole, therefore, it does not require to be cut, it is adjusted without any problem to the footwear being used, since the foot of the user will define the longitude of the short sock upon wearing it.

The incomplete insole, when required, uses any type of system or mechanism in order to avoid it from moving or slipping towards the front of the shoe. This effect can happen upon using this type of insole-sock type insert for shoes.

One of the major advantages of the modified and incomplete insole is that these configurations allow for a greater space or fit for the user's foot, in comparison with the traditional type insole (complete insole). Likewise, any approach of the insole-sock type insert for shoes can be used with such a configuration that prevents that the short sock moves outward (towards the rear part of the insole) once the foot of the user is removed from the sock.

As an additional characteristic, the insole of any approach of the implementation has its own extension, a flap or wing on each side, at variable distance, design, and size, of the same or different material than the insole, that upon being in contact with the sock, allows that the sock keeps an opening in order to facilitate the introduction of the user's foot.

Also, the implementation deals with a certain type of modular insert when using a temporary attachment device of the traditional, incomplete, or modified insole with the short sock, such as in the case of the hook and loop fastener type system.

BRIEF DESCRIPTION OF THE FIGURES

The purpose of this implementation will be better understood with the help of the following description based on a practical performance example; this description was made in compliance with the attached drawings.

DETAILED DESCRIPTION

By making reference to these figures, as described below in a more detailed manner and with different approaches of the implementation.

Figure 1:
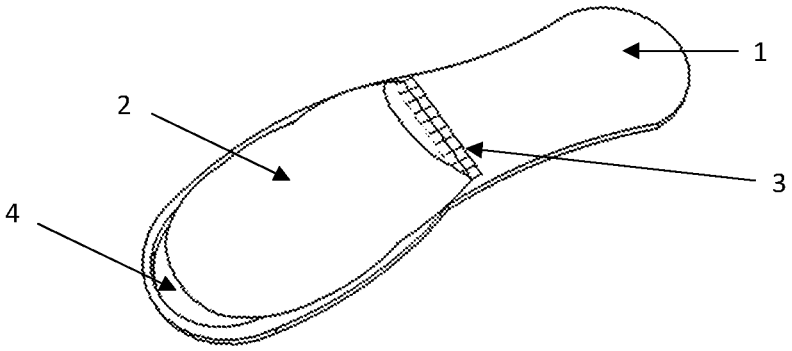
FIG. 1.—Isometric view of the insole-sock type insert for shoes, with a modified insole.

In FIG. 1, we can see an isometric view of one of the approaches of the insole-sock type insert for shoes, which is used to give a general view of the implementation in question and all of its approaches. We can see a (1) modified insole and sock (2) or a short, medium, or modified one, which together form our insole-sock type insert for shoes. It can also be seen the attachment method (3), within where, in a descriptive manner, we refer to a seam (3) that keeps the insole in place (1), and the sock (2), where the height of this seam (3) can vary depending on the characteristics of the insole to be used and/or the footwear. In the front part of the implementation, a gap can be seen (4), which has no insole (1) without a sock (2); this FIG. 1, shows one of the implementation approaches, but the main characteristic of the implementation is that the sock (2) and the insole (1) are only attached where the seam is placed (3), which means, the sock (2) is free and adjusts to the size of the user's foot. In this case (FIG. 1) there is a gap (4) under the sock (2), which prevents the elimination of a proper fit from the corresponding footwear. If desired, the rear surface of the insole can have a layer comprised by cloth of the same material of the short sock (2) that is used, or, it is the short sock (2) that also extends over the rear surface of the insole (1); being able to apply this in any insole that may be possible.

Figure 2:
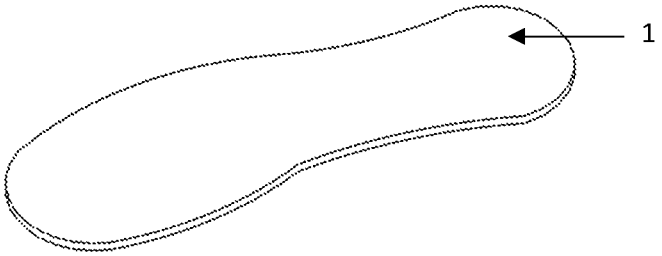
FIG. 2.—Isometric view of the traditional insole.
Figure 3:
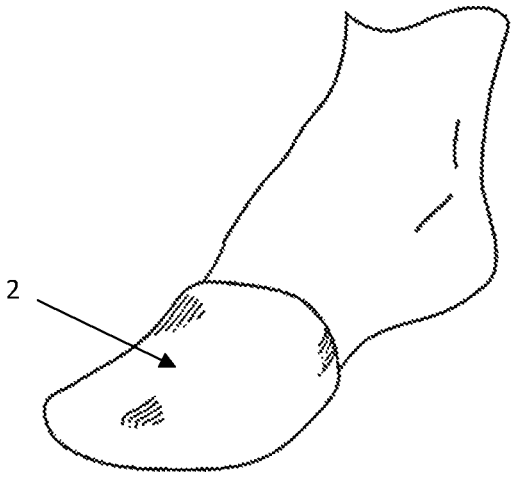
FIG. 3.—Short, medium, or modified common sock being used by the user.
Figure 4:
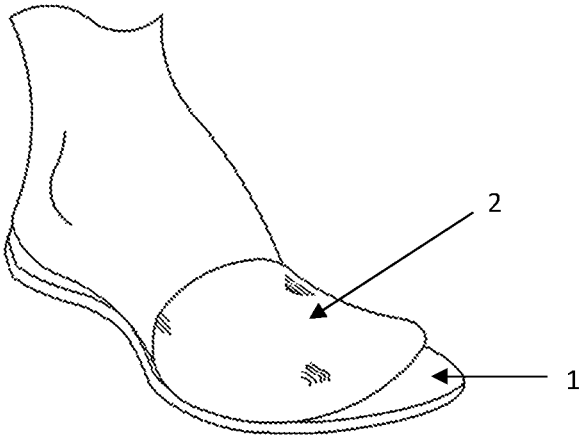
FIG. 4.—Isometric view of an insole-sock type insert for shoes, being worn by a user.

In FIG. 2 we can see a traditional insole (1), which can store a sock (2) of a short, medium, or modified size at a desired distance, attaching them with a seam (3), or of any other type of mechanism that serves for the same purpose. In FIG. 3, we see a short, medium, or modified sock (2) in order to understand the way it is used in our implementation, which adjusts in a simple manner to the user's foot. In FIG. 4 a short sock (2) can be seen, attached to a traditional insole (1) (complete). It can be seen that the sock has free mobility and it feels as if you were not wearing an insole.

Figure 5:
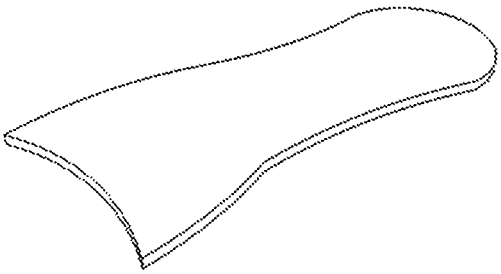
FIG. 5.—Incomplete insoles, at a variable distance.
Figure 5:
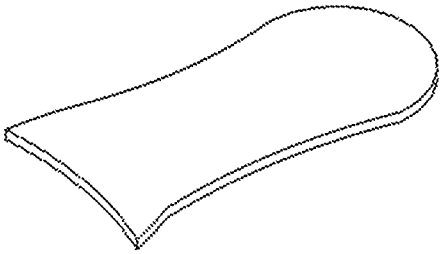
Figure 5:
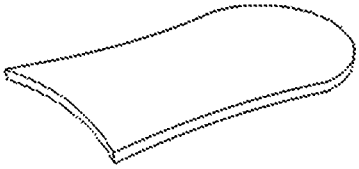
Figure 6:
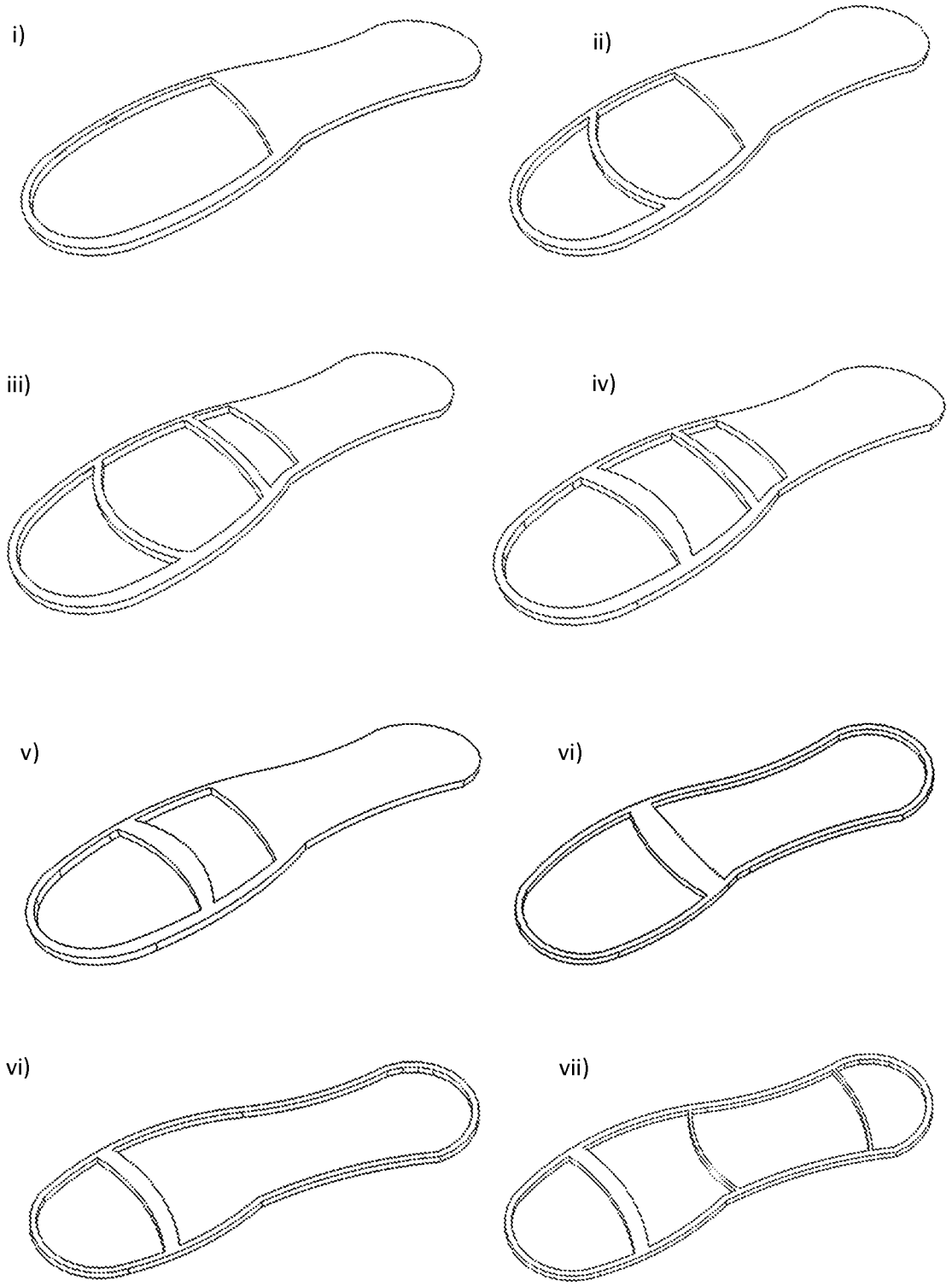
FIG. 6.—Modified insoles, with variable configurations.

Within FIGS. 5 and 6 we can see differently configured insoles, in which the insoles shown in FIG. 5 represent a series of incomplete insoles of a variable size, while in FIG. 6, the modified insoles can be seen. In the incomplete insoles (FIG. 5), shown from top to bottom, it can be seen that i) its bigger in comparison to ii), with the latter, being bigger than iii). There are no fixed or pre-established sizes, the importance lies in the essence and function that each one of them represents. These incomplete insoles can use an adhesive, seam, or any type of system or mechanism to prevent them from moving or slipping inside the shoe. The modified insoles from FIG. 6 have different configurations that provide more stability for the complete insole, in comparison to the incomplete insoles. Both types of insoles, incomplete and modified, have the characteristic of giving the footwear a better fit, which means that they will not take space from the shoe due to the use of the insole-sock type insert for shoes. Another one of the common characteristics is that they are attached to a short, medium, or modified sock to adapt to our implementation; where the sock will be attached to a variable height depending on the type of insole that will be used.

Figure 7:
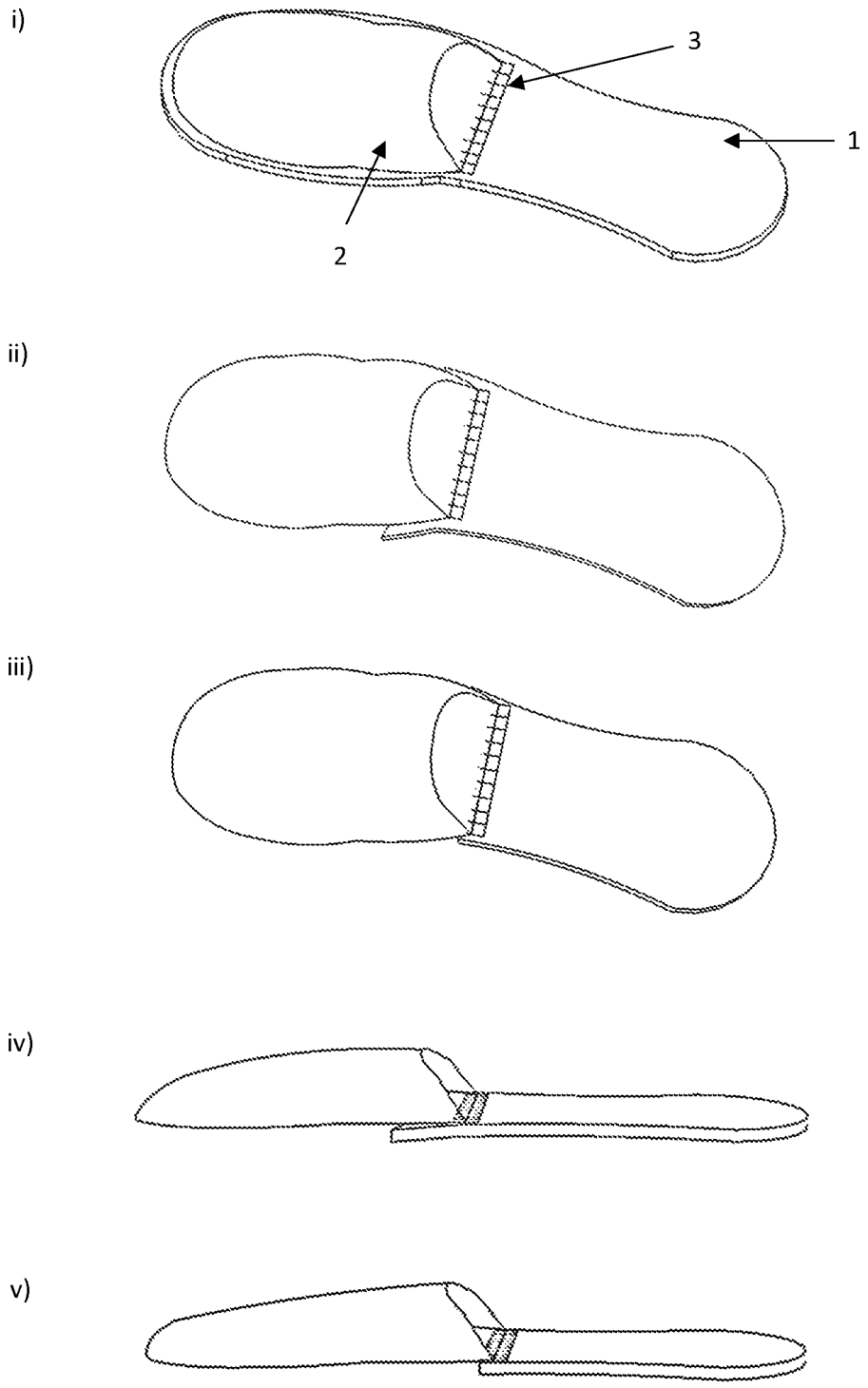
FIG. 7.—Top and side isometric views of the insole-sock type insert for shoes, where a short, medium, or modified sock can be seen, attached to a traditional insole and different type of incomplete insoles.

FIG. 7 shows insole-socks inserts for shoes, where the sock (2) is short, medium, or modified and is attached to the insoles (1) of a variable size. We can appreciate that the insert i) is a traditional (1) insole; ii) and iii) show top views, where the insoles are incomplete, where ii) is bigger than iii). Additionally, iv) and v) have side views of ii) and iii) respectively.

Figure 8:
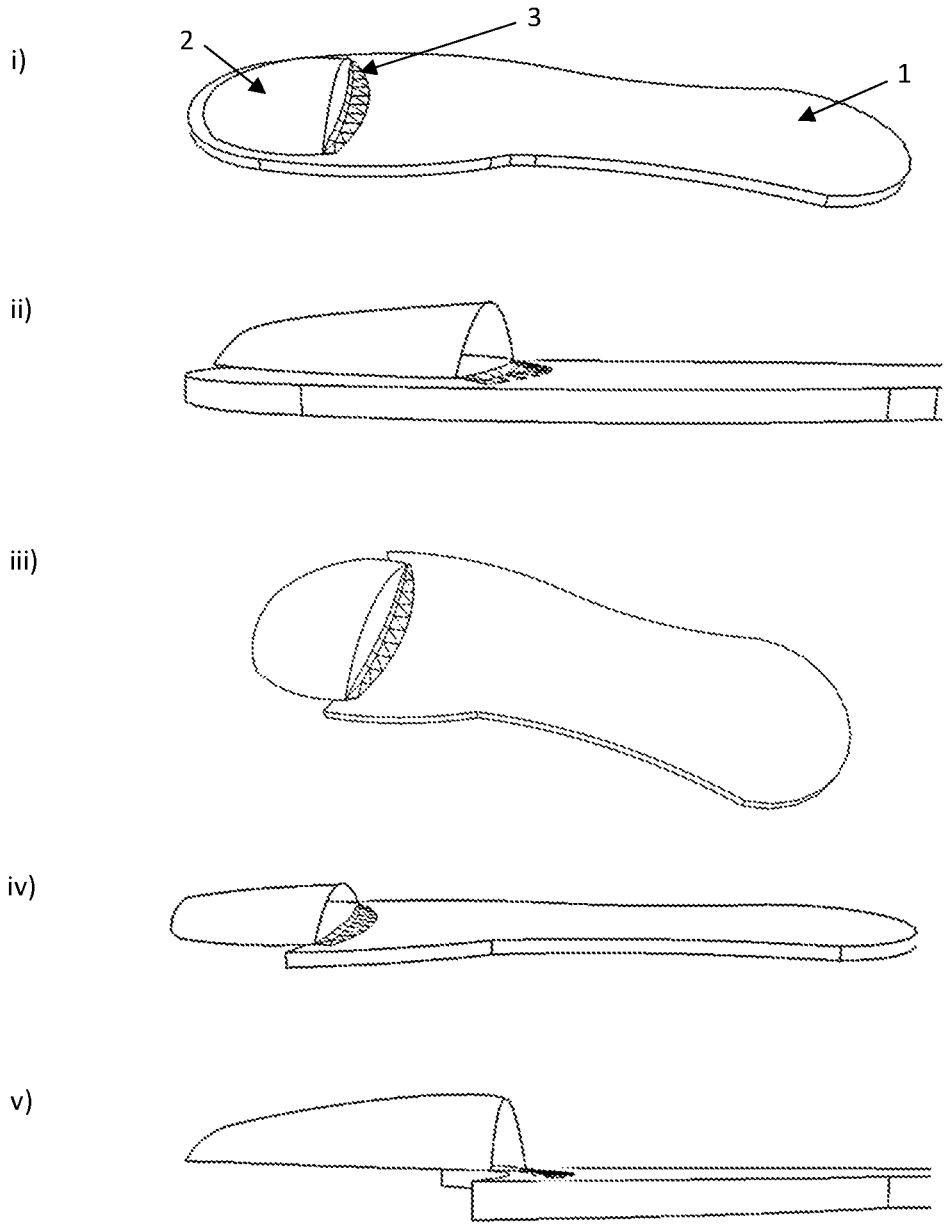
FIG. 8.—Top and side isometric views of the insole-sock type insert for shoes, in which a short, medium, or modified sock can be seen (in such a size that only covers the toes), attached to a traditional insole and to an incomplete insole.

FIG. 8 shows two other different approaches of our implementation, where the sock (2) used is short, medium, or modified, and smaller size than the one previously represented in this description. This sock size (2) is ideal when the user only wants that the sock protects his toes. Image i) and ii) use a traditional insole, while iii), iv), and v) show different views where the insole is an incomplete insole, in a manner that one minimum front part of the insole (1) is absent, or, the insole (1) is incomplete at a distance that is very near to the height of the user's toes.

Figure 9:
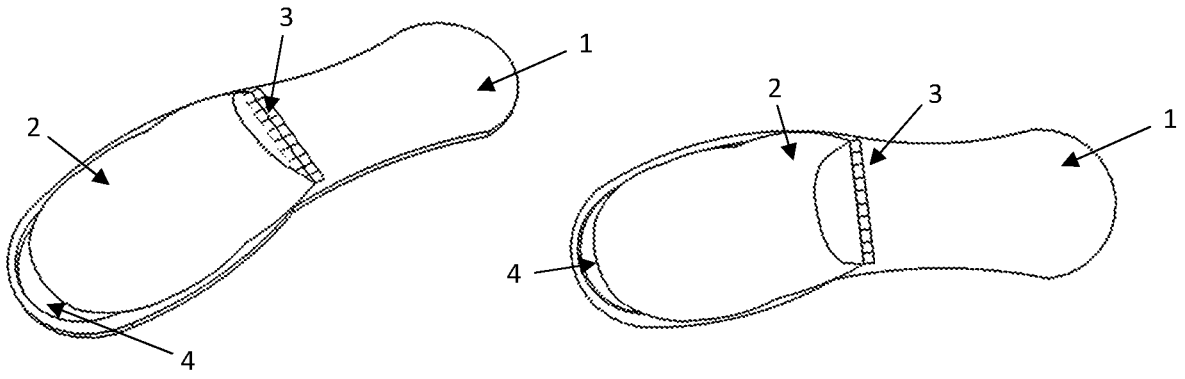
FIG. 9.—Top isometric view of an insole-sock type insert for shoes, where a short, medium, or modified sock can be seen, attached to a modified insole.
Figure 10:
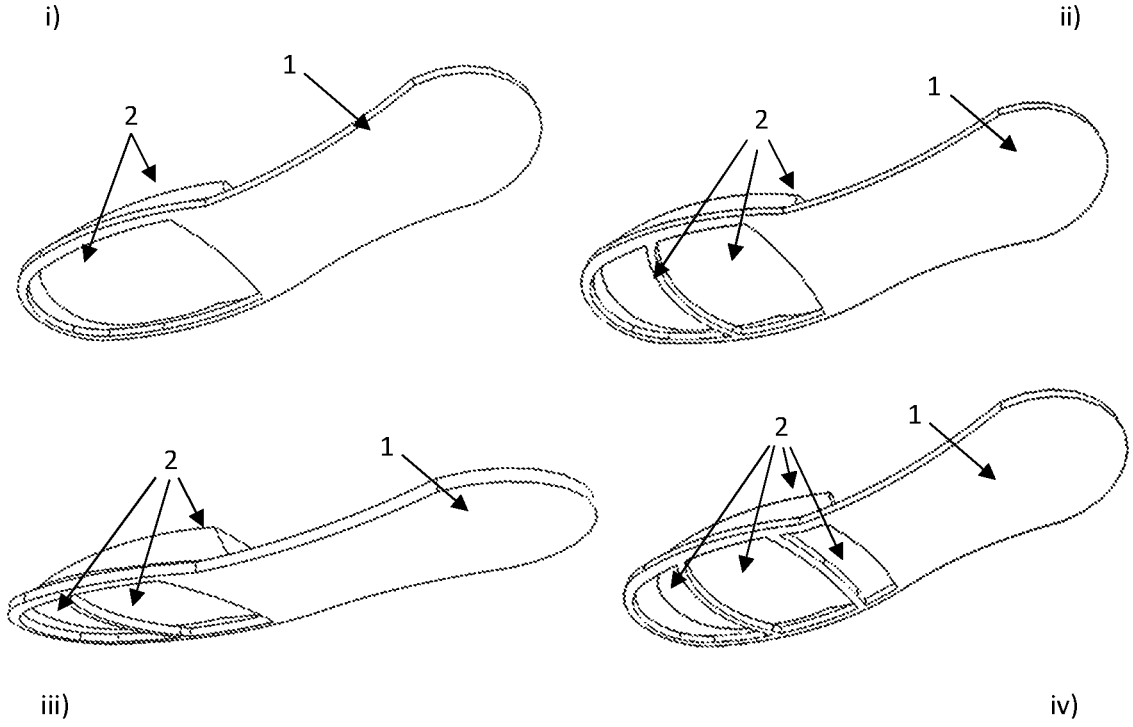
FIG. 10.—Lower isometric views of an insole-sock type insert for shoes, where a short, medium, or modified sock can be seen, attached to a different variety of modified insoles.
Figure 11:
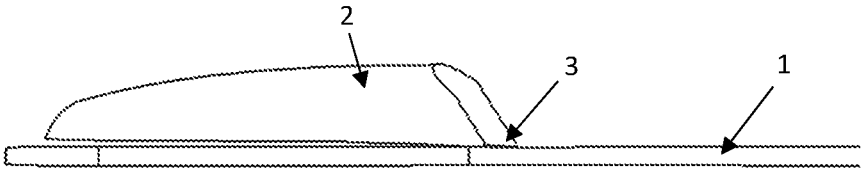
FIG. 11.—Variable isometric views with a zoom of an insole-sock type insert for shoes, where a short, medium, or modified sock can be seen, attached to a modified insole.
Figure 11:
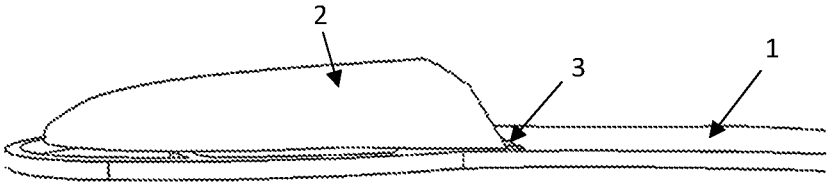
Figure 11:
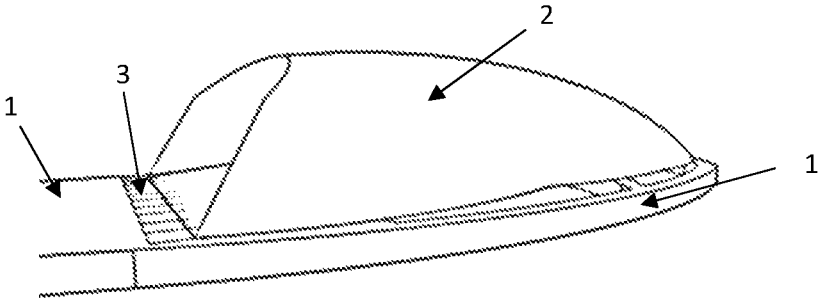
Figure 11:
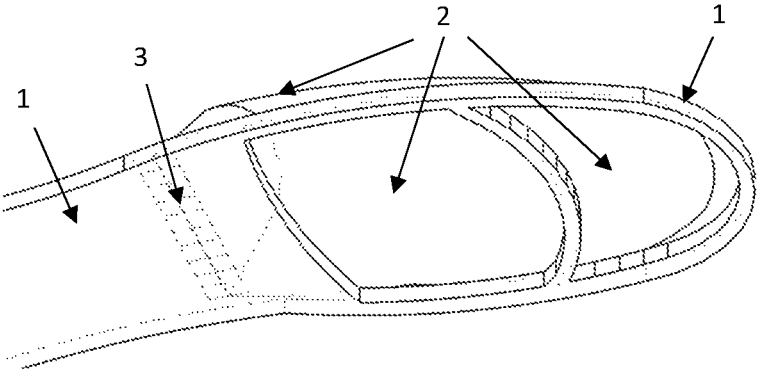

Similarly to FIGS. 7 and 8, FIGS. 9 and 10 show different views of one of the approaches of our implementation, where there are insoles used that are (1) modified. FIG. 9 shows top views, and FIG. 10 shows lower views with different configurations of insoles. Such configurations vary depending on the hollowness or gap wanted, or, of the stability that is to be given to the insole (1). FIG. 11 shows variable views with a zoom of figures ii) or iii) of FIG. 10, in order to see the configuration in more detail. It can be seen more clearly that the sock (2) is found unattached from the front part of the modified insole (1), being attached only at a distance defined by the seam (3), which varies depending on the implementation approach.

Figure 12:
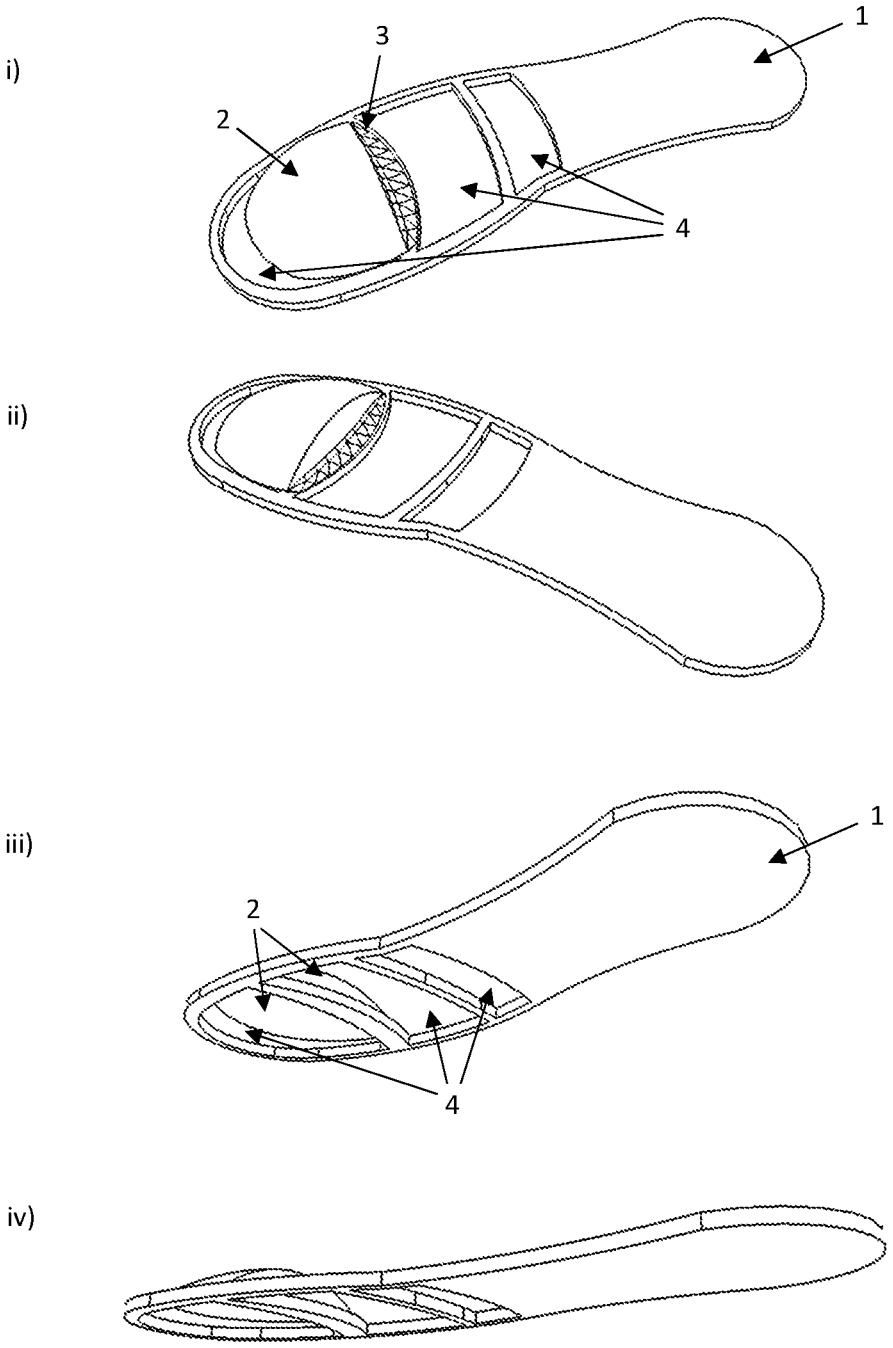
FIG. 12.—Variable isometric views of an insole-sock type insert for shoes, where a short, medium, or modified sock can be seen (in such a size that only covers the toes), attached to a modified insole.
Figure 13:
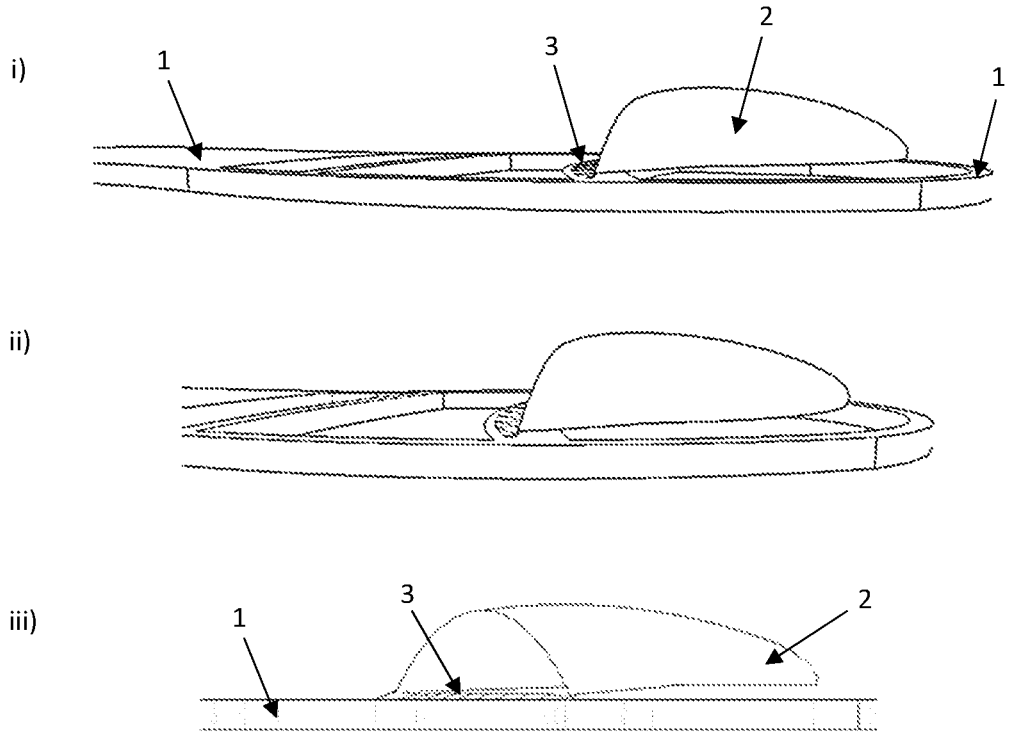
FIG. 13.—Variable isometric views with a zoom of an insole-sock type insert for shoes, where a short, medium, or modified sock can be seen (in such a size that only covers the toes), attached to a modified insole.

Image 12 shows an approach that uses a short sock (2), which only covers the user's toes and a modified insole (1) with the same configuration that can be seen in iv) of FIG. 6. This approach can also be used with an insole as v) of FIG. 6, or with some other particular design of the modified insole (1) that has a surface at the corresponding height to make a seam or use some other type of attaching method between the short sock (2) and the modified insole (1) at a distance that is equal or similar to the one shown in FIG. 12. Using i) from FIG. 12 as an example, it can be seen that within this configuration, the modified insole (1) still has two gaps (4) that are totally free, which means, there is no sock (2) present in regards to these gaps (2), but it is present over the gap (4) of the front part of the insole, gap that is at the same height of the user's toes. FIG. 13 shows different views at variable zoom from the approach shown in FIG. 12, where the zone where the sock is located can be seen up-close (2).

Figure 14:
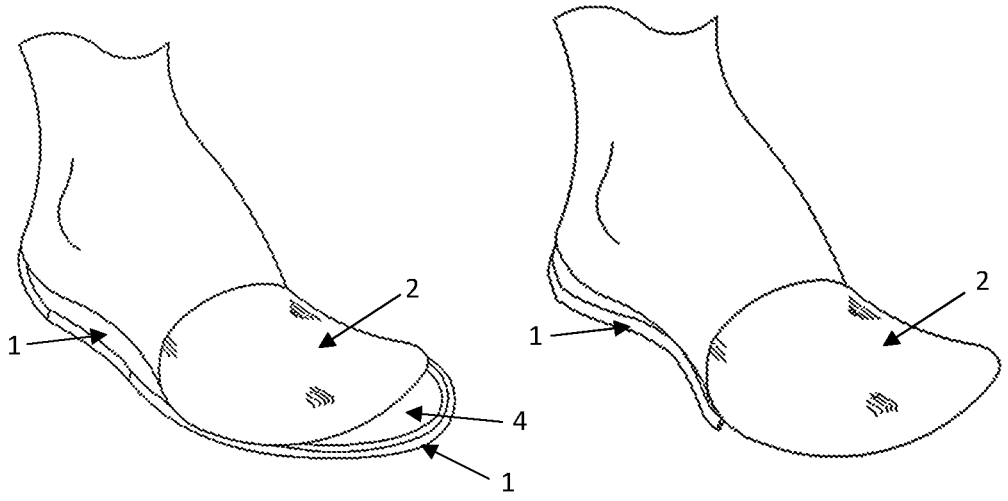
FIG. 14.—Isometric view of two insole-sock type inserts for shoes, being worn by a user, with both inserts being made up of by a short, medium, or modified sock, where one of them (left) is attached to a modified insole and the other (right) is attached to an incomplete insole.

FIG. 14 shows two different approaches of our implementation with the visualization of a foot from a user. The one on the left is shown with an insole (1) that is modified in which there exists a frontal surface; and the one in the right side is dealing with an incomplete insole (1) approach.

Figure 15:
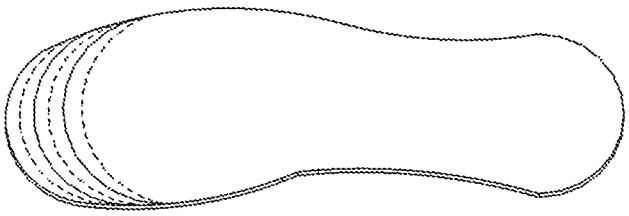
FIG. 15.—Example of an adjustable size insole.

Additionally, FIG. 15 represents an example of an adjustable insole, with our implementation being of an adjustable size to a certain size number. It should be made clear that incomplete insoles would not have this problem, and modified insoles can be adjustable, as long as the configuration allows doing so, whether it is by cutting the front part or the heel part. Moreover, even if part of the insole is cutout in order to obtain a smaller size, the short sock (2) will not have problems since it will adjust to the user's foot.

Figure 16:
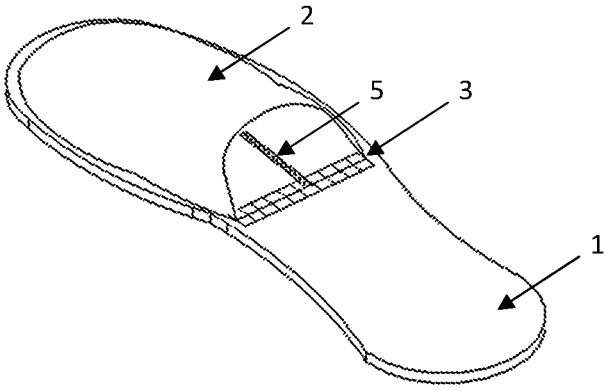
FIG. 16.—Isometric view of an insole-sock type insert for shoes, where a seam or attachment device (5) can be seen, between the insole, the sock, and the seam (3).

In FIG. 16 another seam or attachment means (5) can be seen, which prevents the sock from coming out once the user's foot is removed. It allows for the sock to have greater stability, but the main function is to prevent the short sock from coming out. It is understood that this approach only applies to traditional and modified insoles which have enough space to be able to perform such seam (5). Another type of adhesive or device can also be used, in order to provide the same function.

Figure 17:
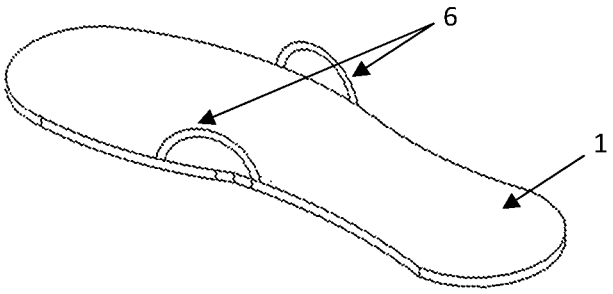
FIG. 17.—Isometric view of a traditional insole, with some flaps that are part of the same insole.
Figure 18:
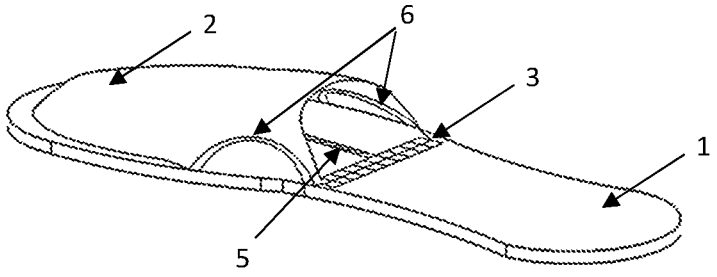
FIG. 18.—Isometric view of the insole-sock type insert for shoes, with a traditional insole with flaps.
Figure 19:
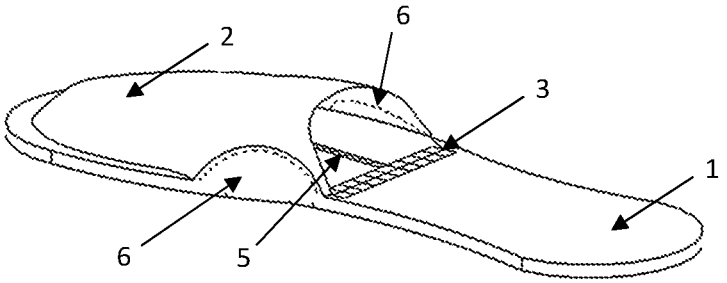
FIG. 19.—Isometric view of the insole-sock type insert for shoes, with a traditional insole and with another type of flaps.
Figure 20:
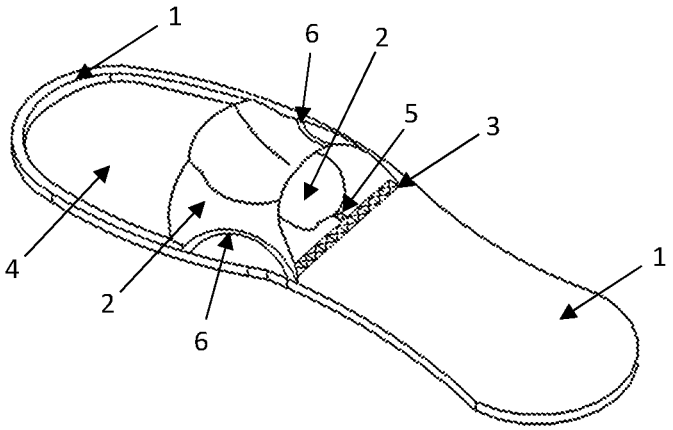
FIG. 20.—Isometric view of the insole-sock type insert for shoes, with a gap modified insole in the front part, and with flaps, with the corresponding seams and a short, medium, or modified sock, where a pulled sock towards the rear part is shown.

FIG. 17 shows two extensions or flaps (6) of a traditional type insole (1) (which can also be incomplete and modified insoles) on each one of its sides, at a variable distance, design, or of the same or different material than the insole, that upon being in contact with the sock (2) allows the sock (2) keeping an opening in order to facilitate the introduction of the user's foot. It should be clarified that any type of method or device can be used, which allows for the sock to remain open for greater ease upon inserting the user's foot. FIGS. 18, 19, and 20 show isometric views of the insole-sock type insert for shoes, where it can be seen that the use of the seam (5) prevents the sock from coming out completely, and there are also two different types of extensions or flaps (6) (FIGS. 18 and 20 use the same design, in contrast to the flaps of FIG. 19) connected to the short, medium, or modified sock (2), in order to keep to some extent an opening within the sock (2). The insoles (1) of FIGS. 18 and 19 are traditional, and insole (1) of FIG. 20 is modified, where only the front part of the insole has a gap, allowing for greater fit.

Also, there are certain advantages and benefits that arise from the current implementation, such as the resolution to problems in regards to bad odor when it is worn to give the sockless look. The foot friction problem is also resolved in regards to causing blisters and calluses when in direct contact with footwear. It should be considered that the insole-sock type insert for shoes is a product that can be washed without altering the functional and technical combination of the structure that is described in this report.

The present implementation is better used in nautical type shoes or those of the similar type; however, the present implementation fulfills the functions described in this report when used in any type of footwear.

It should be understood that what is shown here is merely illustrative of current preferential approaches of the implementation and that there are no limitations due to the details of the manufacture or design in this document, other than the description made in the enclosed claims. The modifications which may result after taking into account the present descriptive report are included, as well as the different uses that can occur in addition to those mentioned herein.

The invention claimed is:

1. An insert for footwear, the insert comprising:

an insole configured to be removably inserted into an article of footwear; and a sock directly and nonremovably attached to the insole, the sock comprising a closed front portion configured to receive the toes of a user and a rear portion opposite the front portion;

wherein the insole extends beyond and more forward than the closed front portion of the sock;

wherein the closed front portion of the sock is configured to lift away from the insole;

wherein the closed front portion of the sock is not directly attached to the insole;

wherein an entirety of the insole is comprised in substantially a single plane and the entirety of the insole is configured to be substantially below the user's foot when the user wears the insert; and wherein the insole and the sock are configured to expose a heel of the user when the user wears the insert.

2. The insert of claim 1, wherein one of a middle portion of the sock or the rear portion of the sock is attached to the insole through a seam that extends from one of the middle portion of the sock or the rear portion of the sock towards the closed front portion of the sock, wherein the seam is substantially centered between two opposing sides of the insole.

3. The insert of claim 1, wherein the insole further comprises a flap extending from a first side of the insole, wherein the flap is configured to maintain an opening in the sock.

4. The insert of claim 3, wherein the flap is directly coupled to the sock.

5. The insert of claim 1, wherein a front portion of the insole comprises one or more openings therethrough.

6. The insert of claim 5, wherein a perimeter of an opening of the one or more openings corresponds in shape to a shape of an outer perimeter of the front portion of the insole.

7. The insert of claim 1, wherein the insert is configured to couple to the article of footwear through one of an adhesive, hook and loop fasteners, or a seam.

8. The insert of claim 1, wherein the rear portion of the sock is attached to the insole at two opposing edges of the rear portion of the sock and the middle portion of the sock is attached to the insole at a portion of the middle portion of the sock substantially centered between two opposing edges of the middle portion of the sock.

9. The insert of claim 1, wherein the insole is configured to extend from a rear end of the article of footwear to a front end of the article of footwear when the insole is inserted into an article of footwear.

10. The insert of claim 1, wherein the insole further comprises a first flap extending from a first side of the insole and a second flap extending from a second side of the insole, wherein the first flap and the second flap are configured to maintain an opening in the sock and are directly coupled to the sock.

11. The insert of claim 10, wherein the first flap and the second flap are sewn to the sock.

12. An insert for footwear, the insert comprising:

an insole configured to be removably inserted into an article of footwear; and a sock directly and nonremovably attached to the insole, the sock comprising a closed front portion configured to receive the toes of a user and a rear portion opposite the closed front portion;

wherein a front portion of the insole comprises one or more openings extending entirely through the insole;

wherein the sock is configured to at least partially fill the one or more openings when the sock is worn by the user; and wherein the closed front portion configured to receive the toes of the user is configured to entirely lift away from the insole;

wherein an entirety of the insole is comprised in substantially a single plane and the entirety of the insole is configured to be substantially below the user's foot when the user wears the insert; and wherein the insole and the sock are configured to expose a heel of the user when the user wears the insert.

13. The insert of claim 12, wherein a width of an opening of the one or more openings comprises a width substantially the same as a width of the sock.

14. The insert of claim 12, wherein a middle portion of the sock is directly attached to the insole through a seam that extends towards the front portion of the insole, wherein the seam is substantially centered between two opposing sides of the insole.

15. The insert of claim 12, wherein a middle portion of the sock is attached to a middle portion of the insole substantially centered between two opposing edges of the middle portion of the sock and a rear portion of the sock is attached to the insole at two opposing edges of the rear portion of the sock.

16. The insert of claim 15, wherein the middle portion attached to the insole of the sock is configured to prevent the sock from turning inside out when a foot is withdrawn from the sock.

* * * * *